United States Patent [19]

Oldweiler

[11] 4,379,046

[45] Apr. 5, 1983

[54] INTEGRATED TWO STAGE COKING AND STEAM CRACKING PROCESS AND APPARATUS THEREFOR

[75] Inventor: Morey E. Oldweiler, Chester, N.J.

[73] Assignee: Exxon Research & Engineering Co., Florham Park, N.J.

[21] Appl. No.: 272,503

[22] Filed: Jun. 11, 1981

[51] Int. Cl.[3] ..... C10G 51/02; C10G 9/32; F27B 15/08

[52] U.S. Cl. ..... 208/54; 208/127; 208/164; 208/160; 422/145; 422/147

[58] Field of Search ..... 208/54, 127, 164; 48/197 R; 422/145, 147

[56] References Cited

U.S. PATENT DOCUMENTS

| | | | |
|---|---|---|---|
| 2,470,395 | 5/1949 | Gohr et al. | 422/147 |
| 2,589,124 | 3/1952 | Packie | 208/164 |
| 2,654,699 | 10/1953 | Lesher | 422/145 |
| 2,756,195 | 7/1956 | Adams | 208/127 |
| 2,763,601 | 9/1956 | Martin et al. | 208/48 Q |
| 2,838,382 | 6/1958 | Ringgenberg | 422/145 |
| 2,846,360 | 8/1958 | Jahnig | 208/126 |
| 2,859,168 | 11/1958 | Downing et al. | 208/48 R |
| 2,871,183 | 1/1959 | Smith et al. | 208/54 |
| 2,881,130 | 4/1959 | Pfeiffer et al. | 208/127 |
| 2,943,993 | 7/1960 | Sykes | 208/48 R |
| 2,952,619 | 9/1960 | Metrailer et al. | 208/127 |
| 3,261,775 | 7/1966 | Blaser | 208/127 |
| 3,641,190 | 2/1972 | Kivlen et al. | 585/648 |
| 3,661,543 | 5/1972 | Saxton | 48/206 |
| 3,816,084 | 6/1974 | Moser et al. | 48/206 |
| 3,855,070 | 12/1974 | Squires | 208/127 |
| 4,297,202 | 10/1981 | Blaser | 208/54 |

FOREIGN PATENT DOCUMENTS 1077918 8/1967 United Kingdom .

*Primary Examiner*—Delbert E. Gantz
*Assistant Examiner*—O. Chaudhuri
*Attorney, Agent, or Firm*—Rebecca Yablonsky

[57] ABSTRACT

The invention relates to an improvement in an integrated, two stage coking and steam cracking process for the production of unsaturated light hydrocarbons. A heavy hydrocarbonaceous oil is first coked in a fluid coking zone. High temperature cracking in the presence of steam is carried out on the vaporous coker conversion product by injecting into the vapors a stream of hot coke particles at a sufficient temperature and in sufficient amount to raise the coker vapors to steam cracking temperature and supply the endothermic heat of reaction. Solids are separated from gas in a gas-solids separation zone such as one or more cyclones and sent to the fluid coking zone and the gas is quenched to stop olefin degradation reactions. According to the improvement, a portion of the separated solids is diverted from entering the fluid coking zone so that the amount of separated solids it receives is only sufficient to satisfy its heat requirement. Solids may be diverted via the cyclone dipleg. An internal standpipe connected to the cyclone dipleg and having a valve and associated riser may be used to regulate the amount of separated solids permitted to enter the fluid coking zone.

14 Claims, 2 Drawing Figures

INTEGRATED TWO STAGE COKING AND STEAM CRACKING PROCESS AND APPARATUS THEREFOR

FIELD OF THE INVENTION

This invention relates to an integrated, two stage coking and steam cracking process (cocracking) and apparatus for the production of products including unsaturated light hydrocarbons, particularly $C_2$–$C_4$ olefins and diolefins, useful as chemicals and chemical intermediates.

BACKGROUND OF THE INVENTION

Steam cracking is a well known process and is described in U.S. Pat. No. 3,641,190 and British Pat. No. 1,077,918, the teachings of which are hereby incorporated by reference. In commercial practice, steam cracking is carried out by passing a hydrocarbon feed mixed with 20–90 mol % steam through metal pyrolysis tubes located in a fuel fired furnace to raise the feed to cracking temperatures, e.g., about 1400° to 1700° F. and to supply the endothermic heat of reaction.

The fluid coking process for the production of fuels, such as gas oil and naphtha is well known and is disclosed in U.S. Pat. No. 2,881,130, the teachings of which are hereby incorporated by reference. Integrated fluid coking and coke gasification processes are also known and disclosed, for example, in U.S. Pat. Nos. 3,661,543 and 3,816,084, the teachings of which are hereby incorporated by reference.

Fluid coking processes for the production of chemicals and chemical intermediates are also known, see, for example, U.S. Pat. Nos. 2,846,360 and 2,871,183. Generally, when it was desired to produce chemicals rather than fuel oils, heretofore, the fluid coking process usually included a high temperature transfer line cracking zone and a fluidized bed coking zone.

It is also known to introduce a small amount of hot solids into a gas-solids separation zone, such as the cyclone separator, used to separate entrained solids from the vaporous coker product, so as to prevent coke deposition on the walls of the cyclone separator, see for example, U.S. Pat. Nos. 2,763,601; 2,859,168 and 2,943,993. This treatment is known as scouring. For scouring coke the amount of heat to be added need only be enough to uphold the temperature of the vapors and prevent them from depositing coke whereas the heat load is much greater for stream cracking.

The present process relates to and is an improvement on Japanese application No. 44315/78, based on U.S. Ser. No. 789,569, now abandoned.

In cocracking a carbonaceous material is coked in a first stage fluid coking zone and the resulting varporous coker conversion product is passed to a second stage reaction zone where it is heated in the presence of steam to a temperature adapted to crack the same to products including low molecular weight unsaturated hydrocarbons. This is achieved by injecting a stream of hot solids at a suffciently high temperature and in sufficient amount into the vaporous coker conversion product passing to a gas-solids separation zone. The hot solids may be supplied by a coke gasification zone.

In cocracking there are two stages in the reactor, which are operated at different temperatures and which accomplish different purposes, viz., coking and steam cracking. These two stages are carried out in the same environment and in close proximity to each other. The first stage is suitably carried out in a large fluidized bed of solids which is fed a preheated coking feed, typically a vacuum residuum. The second stage is suitably effected in a smaller, dilute phase which is fed vapor from the first stage. The main flow of solids which supplies heat for both stages, flows counter-current to the flow of hydrocarbon feed.

Although the temperatures for the two stages are disparate, it was found that these two reactions can be coordinated and caused to take place in the same vessel.

This problem of temperature control is more acute when high flow rates of heat-carrying solids to the dilute phase are used in order to reach the preferred, higher than minimal steam cracking temperatures, inasmuch as these solids—after heat exchange with the coking vapors and separation from product gas in the gas-solids separation zone—normally pass into the coking zone and could heat the latter excessively. One way of maintaining suitable coking temperatures in the coking zone involves cooling it by replacing part of the injected steam with water.

The mode of regulating the temperatures of the two stages in cocracking while reducing the reactor heat duty, is the subject of this invention.

SUMMARY OF THE INVENTION

According to the present improvement, the temperatures of the two stages are regulated and maintained at their respective desired levels by removing at least a portion of the solids separated in the gas-solids separation zone from the reactor so that they are prevented from passing into the coking zone, a remainder portion being allowed to enter the latter so as to provide the heat requirement thereto for the endothermic coking reaction. At least a sufficient amount of hot solids is introduced into the second stage dilute phase to supply this requirement. Conveniently this is achieved by using a gas-solids separator comprising at least one cyclone and withdrawing a portion of hot solids from the cyclone dipleg. The cyclone dipleg withdrawal is facilitated by employing a standpipe within the reactor, connected to the cyclone dipleg to receive separated solids therefrom and having an outlet for overflow of solids into the coking zone and an external riser for solids removal, viz., they may be recycled to the gasification zone. A valve in the standpipe permits regulating the distribution of the separated solids between the overflow outlet and the riser whereby the temperature of the coking zone can be controlled at just the desired level without use of cooling. This means that not all of the solids separated in the cyclone are degraded to the considerably lower temperature of the coking zone since at least some are removed without this occurring. The thus removed solids, which are at steam cracking temperature, need only be raised through a smaller temperature gradient to be brought up to a level suitable for again being injected into the dilute phase steam cracking zone. This smaller temperature upgrading for making the solids adapted for reuse reflects the reduction in the reactor heat duty resulting from the removal of water injection to the bed which is no longer needed for bed temperature control.

In the overall process, a carbonaceous feed is passed to the reactor into a coking zone containing a fluidized bed of solids above which there is a dilute phase. A stream of solids having coke deposited thereon is withdrawn from the lower portion of the reactor and passed to a heater in which a fluidized bed of such solids is maintained. A portion thereof is passed to a gasifier having a gasification zone also containing a fluidized bed. In the gasification zone, some coke is burned with steam and oxygen to produce a hydrogen and carbon monoxide fuel gas and to heat the remaining solids. The reactions which may take place are more fully described in U.S. Pat. No. 3,661,543. The fuel gas is introduced into the heater fluidized bed. The gaseous effluent of the heater, including entrained solids, passes through a gas-solids separator which may be one or more cyclones and the heater gaseous effluent is recovered as a fuel gas. Steam cracking is effected by withdrawing a stream of hot solids from the gasifier and injecting it into the dilute phase above the dense fluid bed in the reactor. As described above, a portion of the hot solids, after heat exchange with the vaporous coking zone conversion product and separation from product gas in the gas-solids separator, is removed from the reactor without passing into the coking zone whereas a portion does pass into the latter to supply the heat requirement thereof. The removed solids may be recycled to the gasifier.

DETAILED DESCRIPTION

Figure 1:
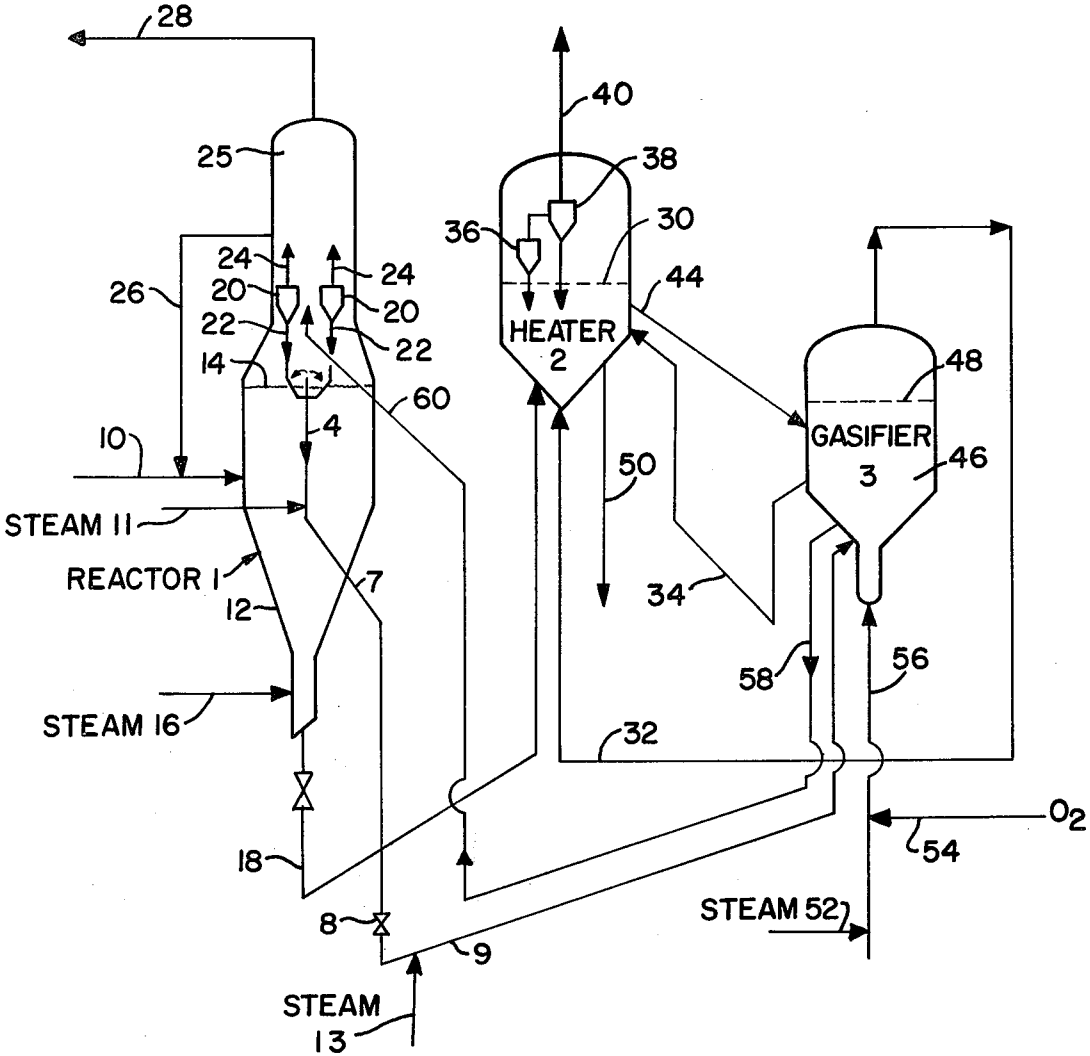
FIG. 1 is a schematic flow plan of one embodiment of the invention.

Referring to FIG. 1, a carbonaceous material for example having a Conradson carbon residue of about 25 weight percent such as heavy residuum having a boiling point (at atmospheric pressure) of about 1050° F.+ is passed by line 10 to reactor 1 into a coking zone 12 in which is maintained a fluidized bed of solids (e.g., coke particles of 20 to 1000 microns in size) having an upper level indicated at 14 above which there is a disperse or dilute phase. Carbonaceous feeds suitable for the present invention include heavy hydrocarbonaceous oils; heavy and reduced petroleum crudes; petroleum atmospheric distillation bottoms; petroleum vacuum distillation bottoms; pitch, asphalt, bitumen, other heavy hydrocarbon residues; coal in comminuted form; coal slurry; liquid products derived from coal liquefaction processes and mixture thereof. Typically such feeds have a Conradson carbon residue of at least 10 weight percent, generally from about 10 to about 50 weight percent (as to Conradson carbon residue, see ASTM test D-189-65). Reactor 1 may be lined internally with a refractory insulating material, not shown. A fluidizing gas, e.g., steam, is admitted at the base of coking reactor 1 through line 16 in an amount sufficient to obtain superficial fluidizing gas velocity in the range of 0.5 to 5 feet per second. A fluidizing gas other than steam may be used which similarly functions to lower the partial pressure of the hydrocarbon in the high temperature cracking zone.

The coking temperature is in the range of about 950° to about 1150° F., preferably about 950° to about 1100° F., more preferably about 950° to about 1050° F. The pressure in the coking zone is maintained in the range from about 5 to about 150, preferably about 5 to about 45 psig. The lower portion of the coking reactor serves as a stripping zone to remove occluded hydrocarbons from the coke. A stream of coke is withdrawn from the stripping zone by line 18 and circulated to heater 2. A gas-solids separation zone such as cyclones 20 serves to remove entrained solids from vaporous products. The cyclone separator system may be one or more cyclones. A baffle 62 (refer to FIG. 2) extends from the sides of the reactor 1 above the fluid bed and terminates in a relatively small diameter top which defines a restricted vapor passageway or duct 66 for the vapors from the fluid bed to the inlet 64 of the cyclones. Cracking takes place in the duct 66 and in the cyclones. The temperature in the cracking zone is maintained in the range of 1200° to 1700° F., preferably about 1300° to about 1500° F., to convert at least a portion of the coking zone conversion product, preferably at least 15% thereof, to lower olefins and diolefins. This is accomplished by introducing a sufficient amount of a stream of hot solids, withdrawn from the gasifier 3 by line 58 and then injected by line 60 above the dense fluid bed, into the dilute phase in the duct 66 leading to the inlet of the cyclones. The zone between the outlet of the hot solids feed line 60 and the cyclone inlet should be as short as possible to keep residence time low (for good selectivity to $C_2$–$C_4$ olefins) but long enough to ensure good mixing and heat transfer between the coke and the gas. Gas residence time in this zone will typically be 0.02 to 0.3 seconds, preferably 0.05 to 0.2 seconds. The amount of solids is in the range of about 1000 to 2500 lbs., preferably about 1200 to 2000 lbs. per barrel of fresh feed and they are at a temperature in the range of 1500° to 2000° F., preferably 1600° to 1800° F. Residence time of the coker vapors at steam cracking conditions, i.e., from the point of injection of the coke to the outlet of the cyclone is approximately one second or less, e.g., 0.2 to 0.8 seconds. The resulting vapor/coke product mixture is separated in the cyclones, the coke passing down into the diplegs 22. The coke separated by the cyclones is preferably at a temperature of about 1300° to about 1500° F.

The apparatus provides means for withdrawing a portion of the coke from the dipleg. Various mechanical configurations may be used to withdraw a portion of the coke from the dipleg with or without stripping or aeration steam to achieve the basic objective of preventing overheating of the coking bed. The following illustrates one such configuration.

An internal standpipe 4 is connected to the cyclone diplegs 22 so as to receive separated solids therefrom. The standpipe or withdrawal means may comprise an upper, wider section 5 having an opening 6 at a level above the level 14 of the dense fluid bed so that solids can overflow into the bed; a lower, narrower, vertically inclined section 7 extending outside of the reactor 1; slide valve 8 and riser 9. Stripping and aeration steam is introduced into the standpipe through line 11 and riser steam is introduced into riser 9 through line 13.

The method of circulating the solids between the coking vessel and the gasifier is in principle substantially the same as that described in U.S. Pat. Nos. 2,881,130 and 2,589,124, incorporated herein by reference. Briefly, the circulation is accomplished by maintaining a relatively low density in the riser pipe 9 and a relatively high density in the standpipe 4 so that the head of pressure at the base of the standpipe serves as a driving force to circulate the solids. The rate of circulation is controlled by the slide valve 8. To ensure proper flow of solids from the standpipe 4 to the gasifier 3, a small amount of aeration steam is injected at intervals along standpipe section 7 (through lines not shown).

Additional steam is injected into the riser 9 through line 13 to control the density in this section of the equipment.

The difference between the rate of solids passing into the diplegs and the rate of solids withdrawal through removal line 9 (controlled as aforesaid) is the rate of overflow of solids into the fluid bed.

The ratio of circulation of these solids between the overflow into the coking bed, and the gasifier, is controlled to supply the required heat for the coking step and to conserve the heat of these solids not so required.

In this way, although a portion of separated solids overflows into the bed to supply the requisite heat to maintain it at coking temperature, whence a stream of coke is withdrawn from the stripping zone via line 18 and circulated to heater 2, another portion of separated solids at steam cracking temperature does not enter the bed but is removed via line 9 and may be recycled to gasifier 3. Another option would be to return all of the separated solids to the gasifier and pass hot solids from the heater 2 to the coking zone 12 through a line (not shown) to supply the heat requirement thereto.

Figure 2:
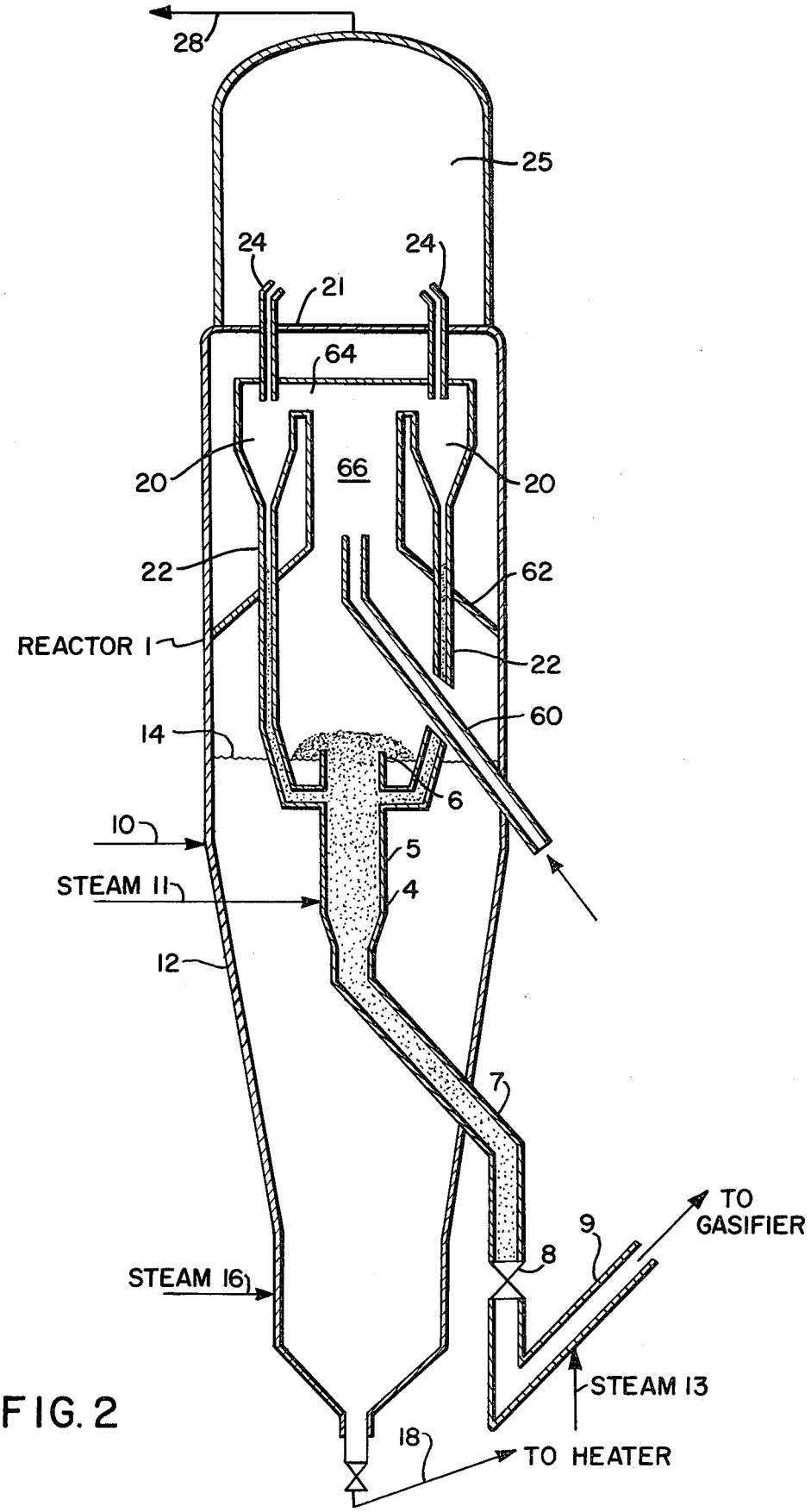
FIG. 2 is a more detailed schematic view of a co-cracking reactor. Like parts are designated by the same numbers as in FIG. 1.

The resulting cracked vapors leave the cyclones through line 24. Line 24 passes through a wall 21 separating the reactor from the scrubber 25 as shown in FIG. 2. The vapors leaving line 24 are quenched in the scrubber to about 600°-900° F. by liquid products from product fractionation. If desired, a stream of heavy material, viz., 950° F.+ products, condensed in the scrubber may be recycled to the coking reactor via line 26. Furthermore, if desired, a portion of the carbonaceous feed may be injected into the scrubber to provide an adequate volume to carry coke fines back to the coking zone. The cyclone conversion products are removed from scrubber 25 via line 28 for fractionation in a conventional manner. In heater 2, stripped coke from coking reactor 1 (commonly called cold coke) is introduced by line 18 to a fluid bed of hot coke having an upper level indicated at 30. The bed is partially heated by passing a hot fuel gas into the heater by line 32. Supplementary heat may be applied to the heater by coke circulating in line 34. The gaseous effluent of the heater, including entrained solids, passes through a cyclone which may be a first cyclone 36 and a second cyclone 38 wherein separation of the larger entrained solids occurs. The separated larger solids are returned to the heater bed via the respective cyclone diplegs. The heater gaseous effluent, which is a fuel gas, is removed from heater 2 via line 40. A portion of coke is removed from heater 2 and passed by line 44 to a gasification zone 46 in gasifier 3 in which is maintained a bed of fluidized coke having a level indicated at 48. If desired, a purge stream of coke may be removed from heater 2 by line 50.

The gasification zone is maintained at a temperature ranging from about 1500° to about 2000° F., preferably from about 1600° to about 1800° F., and a pressure ranging from about 5 to about 150 psig, preferably from about 10 to about 60 psig and more preferably from about 25 to about 45 psig. Steam by line 52 and an oxygen-containing gas such as air, commercial oxygen or air enriched with oxygen by line 54 are passed via line 56 into gasifier 3. The coke particles in the gasification zone and the steam and the oxygen-containing gas undergo an exothermic reaction which supplies heat for the process and produces a hydrogen and carbon monoxide-containing fuel gas. The gasifier product fuel gas, which may further contain some entrained solids, is removed overhead from gasifier 3 by line 32 and introduced into heater 2 as previously described.

In one mode of operating the process, 40,770 barrels per day of fresh feed which is a vacuum residuum is admitted to the reactor 1 via line 10, and 93.4 K lb/hr steam (K=1000) through line 16. A stream of 2784 K lb/hr of 1700° F. coke particles in 50.0 K lb/hr steam is introduced via line 60 above the level 14 of the dense fluidized bed into the dilute phase in the duct 66 leading to the cyclone inlet 64. The hydrocarbon partial pressure in the dilute phase at the cyclone inlet is about 12 psia. Under prevailing conditions the coking bed temperature is 975° F. and the cyclone temperature is 1350° F.

The distribution of coke in the reactor is as follows: Vapors passing into the duct 66 at a temperature of about 996° F. entrain 737 K lb/hr of coke from the dense fluid bed. Coke falling down through the diplegs 22 enters the standpipe 4 at a rate of 3545 K lb/hr comprised of 2784 K lb/hr from the gasifier, 24 K lb/hr of coke formed in the steam cracking zone and 737 K lb/hr entrained by the vaporous conversion product of the coking bed. Aeration steam is introduced into the standpipe via line 11 at a rate of 100 K lb/hr and steam is introduced into the riser 9 at the rate of 20.0 K lb/hr. Coke overflows the standpipe into the coking bed at a rate of 2384 K lb/hr and 975° F. coke flows out of the bed through line 18 to the heater 2 at a rate of 1851 K lb/hr comprised of 1647 K lb/hr that has overflowed the standpipe and 204 K lb/hr formed in the bed; while 1161 K lb/hr of 1350° F. coke is removed through line 9.

In this illustration, 1350° F. coke from the diplegs flows into an internal standpipe. A portion of the coke is withdrawn from the bottom of the standpipe and sent directly to the gasifier. The coke not withdrawn from the bottom overflows into the bed and provides the heat required by the bed. The vapors from the bed are heated to 996° F. by mixing with the 1321° F. aeration steam from the standpipe. This provides preheat and steam dilution which reduces the dew point of the vapors from the bed and reduces coking in the dilute phase. Another advantage of this process is that it provides excellent flexibility for control of the lower bed temperature over a wide range of conditions. It also eliminates the need for water injection to the lower bed to control temperature and this reduces the reactor heat duty. Thus the invention provides direct control of the temperature of the lower bed by providing for withdrawal of a portion of the 1350° F. coke and transferring it directly to the gasifier.

The yield pattern for vacuum residuum will typically include at least about 15 weight % $C_2$–$C_4$ olefins/diolefins, e.g., about 10% ethylene, about 7% propylene, about 4% $C_4$'s and substantial amounts of $C_5$—430° F., 430°-650° F. and 650°-950° F. fractions. A wide range of aromatics produced in the process will be found in the $C_{5+}$ products. Portions of the $C_{5+}$ products may be recycled to coking or to steam cracking to give increased yields of the $C_2$–$C_4$ olefins/diolefins.

Although the process has been described for simplicity assuming circulating coke as the fluidized medium, it is to be understood that the fluidized seed particles on which the coke is deposited may be silica, alumina, zirconia, magnesia, calcium oxide, alundum, mullite, bauxite or the like. The fluidized solids may or may not be catalytic in nature.

Cocracking uses as fuel low cost coke produced in the process from vacuum residuum. Thus the inexpensive feed supplies both the feed and the fuel. In addition, the present improvement makes possible a further energy saving by preserving the heat content of a portion of the coke used in the steam cracking stage.

As previously described, finely divided coal may also be fed to the coking zone. Coal may contain sufficient volatiles so that it is economically attractive to flash them off in the coking zone of the reactor and then crack them to low molecular weight olefins in the duct-steam cracker, the remaining coal (coke) particles forming a fluid coke bed, which coke becomes available as fuel in the gasifier. Similarly, any heavy, 650°+ boiling product which is formed can be recycled to extinction or used directly as fuel in the gasifier. In this manner, hydrogen in the feed is preferentially retained in the hydrocarbon product and not consumed as fuel. Other types of feeds may be introduced supplementarily directly into the duct to take advantage of the steam cracking conditions there, and cracked to products comprising low molecular weight olefins, aromatic naphtha and aromatic gas oil. Such feeds may include gaseous hydrocarbons which conveniently may be introduced into the hot coke riser leading to the duct-steam cracker; and distillates such as naphtha and gas oil which suitably may be preheated in the heater and then introduced into this duct. In this scheme the reactor coking bed is preferably operated at about 1100° F., the heater at about 1100° F. and the gasifier in the range of about 1550° to 1700° F. To compensate for lowered amounts of coke being formed in the coking zone, which serves as fuel for the process—especially when using light feeds such as naphthas and gases which do not form copious amounts of coke—finely divided coal may be fed as fuel to the process as required to heat balance the unit. Correspondingly the reactor coking bed is made smaller. Consequently one may employ a fluidized solids process to crack a wide range of hydrocarbon feeds (from gases to residua) to products including light olefins, using coal as a fuel.

What is claimed is:

1. In an integrated, two stage coking and steam cracking process for the production of products including low molecular weight unsaturated hydrocarbons in which (a) a carbonaceous material is reacted in a reactor in a first stage coking zone containing a bed of fluidized solids wherein steam is introduced to obtain a superficial fluidizing gas velocity in the range of 0.5 to 5 feet per second, maintained at fluid coking conditions including a temperature in the range of about 950° F. to about 1150° F. to form a vaporous coking zone conversion product and coke, said coke depositing on said fluidized solids;

(b) said vaporous coking zone conversion product is passed with entrained solids to a second stage reaction zone;

(c) hot solids at a sufficient temperature and in sufficient amount are introduced into said conversion product entering said second stage reaction zone to raise the conversion product to steam cracking temperatures within the range of 1200° to 1700° F. and supply the endothermic heat of reaction;

(d) solids are separated from product gas within the reactor;

(e) products are recovered comprising low molecular weight unsaturated hydrocarbons, the improvement which comprises:

(f) withdrawing from the reactor a portion of separated solids and preventing its entry into said first stage coking zone; allowing another portion to enter said coking zone and regulating the ratio between the amount of solids withdrawn and the amount of solids allowed to enter said coking zone to maintain the coking zone within said temperature range.

2. The process according to claim 1 in which said hot solids are introduced into a duct above the coking zone leading to a gas-solids separation zone and after heat exchange with the vaporous coking zone conversion product are separated from product gas in the gas-solids separation zone, said first-mentioned portion of solids is withdrawn and said other portion is passed into said first stage coking zone.

3. The process according to claim 2 in which the gas-solids separation zone comprises at least one cyclone having a dipleg and said first-mentioned portion of solids is withdrawn from the dipleg or after passing through the cyclone dipleg.

4. The process according to claim 1, 2 or 3 in which the temperature of said hot solids is in the range of 1600° to 1800° F.

5. The process according to claim 1 in which the coking zone conversion product is steam cracked at temperatures within the range of about 1300° to 1500° F.

6. The process according to claim 1 in which the temperature in the coking zone is in the range of about 950° to about 1050° F.

7. The process according to claim 1 in which the carbonaceous material is a vacuum residuum.

8. In an integrated, two stage coking and steam cracking process for the production of products including low molecular weight unsaturated hydrocarbons in which (a) a carbonaceous material is reacted in a reactor in a first stage coking zone containing a bed of fluidized solids wherein steam is introduced to obtain a superficial fluidizing gas velocity in the range of 0.5 to 5 feet per second, maintained at fluid coking conditions including a temperature in the range of about 950° to about 1100° F. to form a vaporous coking zone conversion product and coke, said coke depositing on said fluidized solids;

(b) a portion of said solids with the coke deposition thereon is introduced into a heating zone maintained at a temperature of from about 1050° to about 1150° F.;

(c) a portion of solids from said heating zone is introduced into a fluid bed gasification zone maintained at a temperature in the range of about 1600° to about 1800° F.;

(d) said vaporous coking zone conversion product is passed with entrained solids to a second stage reaction zone;

(e) a portion of hot solids is withdrawn from the gasification zone;

(f) said hot solids are brought into contact with said vaporous conversion product entering said second stage reaction zone to raise said conversion product to steam cracking temperatures within the range of about 1300° to 1500° F., solids are separated from product gas within the reactor, separated solids are passed to the coking zone and separated product gas comprising low molecular weight unsaturated hydrocarbons is quenched and recovered, the improvement which comprises:

(g) withdrawing a portion of said separated solids and preventing it from entering said coking zone, allowing another portion to enter said coking zone and regulating the ratio between the amount of solids withdrawn and the amount of solids allowed to enter said coking zone to maintain the coking zone within said temperature range.

9. The process according to claim 8 in which said withdrawn portion of separated solids is recycled to said gasification zone.

10. The process according to claim 1 or 8 in which recovered products include $C_{5+}$ products and at least a portion of $C_{5+}$ products recovered is recycled either to the coking zone or to the second stage reaction zone.

11. The process according to claim 3, 8 or 9 in which a standpipe is used to withdraw separated solids and to control the ratio of solids distribution between withdrawal from the reactor and entry into the coking zone.

12. A cocracking reactor which comprises, in combination, a vessel for holding reactants including at least one fluidized bed of coke being a first stage coking zone;

means for introducing feed and fluidizing gas into the bed;

a duct adapted to receive vaporous coking zone conversion product being part of a second stage cracking zone;

means for introducing hot solids into said duct;

gas-solids separation means including at least one cyclone, in open communication with said duct;

an internal standpipe connected to the cyclone dipleg to receive separated solids therefrom and having an outlet for overflow of solids into the bed and an external riser for solids removal;

valve means in the standpipe for regulating the ratio of distribution of separated solids between the overflow outlet and the external riser; and means for removing cold coke from the vessel.

13. Apparatus for carrying out an integrated, two stage coking and high temperature cracking process for the production of products including low molecular weight unsaturated hydrocarbons which comprises, in combination:

a cocracking reactor as set forth in claim 12;

a heater;

a gasifier;

means for passing hot solids from the gasifier and introducing them into said duct;

said riser being connected to said gasifier to recycle removed solids thereto;

means for passing cold coke to the heater;

means for passing solids from the heater to said gasifier;

means for passing hot solids from the gasifier to the heater;

means for introducing hot gases from the gasifier to the heater; and means for withdrawing a fuel gas from the heater.

14. Apparatus for carrying out an integrated, two stage coking and high temperature cracking process for the production of products including low molecular weight unsaturated hydrocarbons which comprises, in combination:

a cocracking reactor as set forth in claim 12;

a gasifier;

means for passing hot solids from the gasifier and introducing them into said duct;

said riser being connected to said gasifier to recycle removed solids thereto; and means for passing cold coke to said gasifier.

* * * * *